US005733444A

United States Patent [19]

Johnson

[11] Patent Number: 5,733,444

[45] Date of Patent: Mar. 31, 1998

[54] DEBRIS CATCHER FOR MANHOLES AND CATCH BASINS

[76] Inventor: Eric A. Johnson, 1408 Ashland Ave., St. Paul, Minn. 55104

[21] Appl. No.: 785,331

[22] Filed: Jan. 21, 1997

[51] Int. Cl.[6] ..... E03F 5/02

[52] U.S. Cl. ..... 210/163; 210/166; 210/232; 404/4; 404/25

[58] Field of Search ..... 210/163, 164, 210/165, 166, 232; 404/2, 3, 4, 5, 25, 26; 52/20

[56] References Cited

U.S. PATENT DOCUMENTS

| | | | |
|---|---|---|---|
| 376,010 | 1/1888 | Redline . | |
| 1,310,055 | 7/1919 | Caldwell | 210/164 |
| 2,615,526 | 10/1952 | Lane | 210/164 |
| 3,621,623 | 11/1971 | Downes . | |
| 3,815,749 | 6/1974 | Thompson | 404/4 |
| 3,973,856 | 8/1976 | Gaglioti . | |
| 4,067,659 | 1/1978 | Campagna, Jr. et al. . | |
| 4,650,365 | 3/1987 | Runnels . | |
| 4,776,722 | 10/1988 | Gaudin | 404/25 |
| 4,919,564 | 4/1990 | Neathery et al. . | |
| 4,957,389 | 9/1990 | Neathery . | |
| 4,974,992 | 12/1990 | Harter . | |
| 5,037,541 | 8/1991 | Ruey - Jang et al. | 210/165 |
| 5,062,735 | 11/1991 | Gaudin | 210/164 |
| 5,130,016 | 7/1992 | Gavin | 404/4 |
| 5,224,514 | 7/1993 | Taylor . | |
| 5,297,367 | 3/1994 | Sainz | 52/20 |
| 5,431,510 | 7/1995 | Reinert, Sr. . | |
| 5,618,416 | 4/1997 | Haefner | 210/166 |

*Primary Examiner*—Peter A. Hruskoci
*Assistant Examiner*—Theodore M. Green
*Attorney, Agent, or Firm*—Haugen & Nikolai, P.A.

[57] ABSTRACT

An annular ring and cap that are positionable within a manhole or catch basin structure above the base of the manhole or catch basin to reduce the amount of debris entering into the manhole or catch basin. The annular ring may be positioned within the manhole or catch basin such that a flange of the annular ring is sandwiched between the base and support frame. When a final grade surrounding the manhole or catch basin is complete and the cover or grating is positioned above the support frame, the cap then serves as a secondary restriction thereby deterring access to underground conduits that are linked to the manhole or catch basin. A plurality of corrosion resistant locking members secure the cap against a ledge of the annular ring. The annular ring further has an inner edge of the ledge that includes first and second shoulder clearance indentations aligned opposite each other.

23 Claims, 6 Drawing Sheets

DEBRIS CATCHER FOR MANHOLES AND CATCH BASINS

BACKGROUND OF THE INVENTION

1. Field of the Invention

This invention relates generally to a device for use in a manhole or catch basin structure and more particularly to a device for restricting the flow of debris into the manhole or catch bash structure. The device is adaptable to be disposed above a base of the manhole or catch bash and may be used both during the construction of roadways and after the final grade has been completed. The device further includes an interlocking frame and lid to thereby deter access into the underground conduits that link manholes or catch basins together. The frame and lid are lightweight, corrosion resistant, durable, and able to withstand a weight bearing load.

2. Discussion of the Related Art

During the construction of roadways, residential developments and streets, sanitary manhole structures are used to provide access to underground conduits. Likewise, storm manhole structures and catch bash structures are used to direct surface water drainage into underground drainage conduits. A manhole structure generally includes a monolithic or precast base, a cone or top slab positioned on top of the base, a support frame positioned above the base or cone, and a cover or grate which rests on the support frame. Extension rings may be positioned between the base or cone and support frame to thereby raise the top of the support frame to the desired elevation. Similarly, a catch bash structure generally comprises a base, a cone or top slab positioned on top of the base, a support frame having a rectangular or a round opening positioned above the base or cone, and a grate which rests on the support frame.

Oftentimes during construction, the underground conduits, base, and cone or top slab are first positioned in the desired location. Next, the grade is raised to the height of the cone or top slab. Then it may be several weeks or months before the support frame is positioned above the cone and the final grade completed. In these instances, a board or metal plate may be placed over the opening in the cone or top slab and gravel or other substrate fill placed over the board or plate. During rainfalls or other water runoff and drainage events, water tends to drain and collect near the partially constructed manholes or catch basins. It is common for loose gavel, sand, silt and other sediment to flow under the board or plate and into the manhole or catch basin structure. The sediment should eventually be removed from the structure requiring additional labor and expense. Hence, there is a need for a device that catches debris and other sediment before it reaches the base of the manhole or catch basin structure.

Both during and after construction it may be desirable to deter access to the manhole opening. Although steel locks and chains have been provided to lock the manhole cover to the support frame, over time these locking devices may become inoperative from exposure to the elements requiring an increased expense to remove the entire cover and support frame. Hence, there is a need for a means to deter access to the manhole opening that will not corrode and become inoperative over time.

Various types of structures have been devised for plugging the top open end of the manhole and catch basin structures until final grade and asphalt work has been completed. For example, U.S. Pat. No. 3,621,623 issued to Downes (hereinafter referred to as "the '623 patent"), discloses an apparatus for temporarily closing an opening formed at the top of a manhole or catch basin. The '623 patent describes a protective membrane that is fixed between the top of the base or cone and the support frame in a position to close the wall opening and having a displaceable central portion for gaining access to the wall opening. However, it does not appear that the '623 protective membrane would support a substantial weight bearing load. Further, although the membrane traps debris and sediment from entering into the manhole, water is also trapped by the membrane. In cold climates, the water may freeze causing damage to the manhole structure and potentially requiring expensive repair. If the water freezes, access into the manhole structure may be limited until the ice thaws and removal of the water or ice from above the membrane can prove costly. Also, the '623 does not provide a means for deterring access through the manhole opening.

U.S. Pat. No. 4,957,389 issued to Neathery (hereinafter referred to as "the '389 patent"), describes a method and apparatus for sealing the open top end of a manhole. A pan is sealed within the opening of the manhole and includes a drain plug in the bottom of the pan. The plug can be pulled to drain the pan. As water drains from the pan, sediment may be carried with the water into the manhole structure. In cold climates the water may freeze in the pan making the plug inoperative. Further, the '389 apparatus for sealing the open top end of the manhole significantly reduces the size of the access opening, thereby limiting the physical size of the operator entering the access opening or requiring additional materials and possible increased expense to increase the opening of the manhole base. The present invention addresses these and other needs.

SUMMARY OF THE INVENTION

The purpose of the present invention is to provide a device that deters access to underground conduits linking manholes or catch basins, wherein the device is positionable above a base of the manhole or catch basin and restricts the flow of debris into the manhole or catch basin structure. In a broad aspect of the present invention, the device generally includes an annular ring, a partially domed cap, and a plurality of locking members.

The annular ring comprises inner and outer concentric sidewalls and is shaped to fit within an opening of the base or cone of the manhole or catch basin. A flange extends outwardly from an upper edge of the annular ring and a ledge extending inwardly from a lower edge of the annular ring towards a center axis of the annular ring. The ledge defines a surface on which the cap rests. Without any limitation intended, a butyl rubber, closed cell sponge rubber saturated with polyurethane, or other sealant of known construction may be applied to the upper surface of the ledge to thereby hermetically seal the cap to the annular ring. An inner edge of the ledge may include indentations which create shoulder clearance and thereby increase the diameter of the access proximate the shoulder clearance indentations. The diameter of the ledge may be increased such that the diameter of the ledge, proximate the shoulder clearance, is approximately equal to the inner diameter of the manhole opening.

The side of the cap is cylindrical in shape having inner and outer concentric sides, wherein the outer side of the cap conforms to the shape of the annular ring. Extending upward from the outer side is a partially domed top surface. The bottom surface of the cap is partially concave, extending upward from the inner side of the cap, thereby partially mirroring the shape of the outer surface of the cap. The bottom surface of the cap includes support ribs extending from the inner side and bottom surface of the cap. When the cap is positioned on the ledge of the annular ring, debris, sediment and water fall along the slope of the partially domed cap, thereby falling towards the lower outer sides of the cap. The debris and sediment may be shoveled away before the cap is removed. A bore may extend through a thickness dimension of the cap, proximate the center of the cap, thereby providing an overflow outlet for water to drain into the manhole system. The ribs reinforce the cap, thereby allowing a weight bearing load to be applied on the cap. A flat planar surface is formed proximate the apex of the top surface of the cap, whereby indicia may be included on the planar surface. Without any limitation intended the indicia may be alpha/numeric to identify the type of manhole or catch basin.

A plurality of corrosion resistant locking members extend from the inner side of the annular ring. The locking members may be formed integral with the annular ring or may be affixed to the annular ring. The locking members protrude inward and include a downward sloping surface. When the cap is aligned and engaged with the ledge, the cap snaps in place underneath the locking members, thereby securing the cap against the ledge of the annular ring. To remove the cap, the cap is pried around the locking members.

Those skilled in the art will appreciate that the locking members may alternately comprise one half of a ball and socket arrangement, a tab and slot arrangement or other similar locking arrangement of known construction. Without any limitation intended, the ball and socket arrangement may comprise partial spheres extending from the sidewalls of the annular ring that interlock with concave indentations formed in the sidewall of the cap. Of course, the spheres may alternatively extend from the cap sidewall and the indentations may be formed in the sidewall of the annular ring. The tab and slot arrangement may comprise tabs extending from the sidewall of the cap that snap into slots formed in the sidewall of the annular ring when the cap is engaged to the ledge of the annular ring.

In use, the outward protruding flange of the annular ring rests on the upper annular surface of the base or cone. Extension rings and the support frame may be stacked on top of the flange, thereby sandwiching the flange of the annular ring between the base and support frame of the manhole. The outer sidewall of the annular ring is dimensioned to fit within the opening of the base or cone. The height of the annular ring sidewalls may be dependent upon the number of extensions ring used and the height of the support frame. During removal of the manhole cover, it is common to allow half of the cover to rotate down into the opening of the support frame. The height of the annular ring should be such that, when the cover rotates down into the opening of the support frame, the outer edge of the cover does not contact the upper surface of the cap.

Once the annular ring is positioned on the top surface of the base or cone, the cap is aligned and engaged to the annular ring. The cap serves to catch debris and sediment flowing into the manhole structure while allowing excess water drainage to overflow into the manhole structure. In warmer climates, it may be desirable to plug the overflow bore, thereby preventing water from draining into the manhole structure. In colder climates, several wedges may be positioned between the ledge and the cap to allow drainage water to drain past the sidewalls of the cap and annular ring. In this manner, water will not be blocked by the cap and access into the manhole structure should not be inhibited by freezing temperatures and resulting ice.

In an alternate embodiment, a rectangular or round cap may include a plurality of perforations formed through a thickness dimension of the cap. Without any limitation intended, the perforated cap may be used in manhole inlet structures. This cap may serve as a grating to block a predetermined size of debris, while allowing water drainage to enter freely into the manhole structure. The perforated cap may also serve as a secondary deterrent from access into the underground conduits linking the manholes and catch basins.

In another alternate embodiment, the upper surface of the cap may be partially conical in shape, wherein, when the cap is aligned and engaged to the annular ring, at least a portion of the partially conical top surface of the cap extends upward and outward above the support frame. The cap has a plurality of perforations formed through a thickness dimension of the cap and further includes an enlarged perforation or overflow outlet formed through a thickness dimension of the cap near the apex of the conical cap. In use, during the construction of the manhole, the annular ring and conical cap may be positioned on top of the cone of a manhole. A filtering fabric or other filtering medium of known construction could be positioned around the conical upper surface of the cap. During heavy rains or other drainage events, the water level may raise above the top of the cone of the manhole and may even submerge the conical cap. The filtering fabric would prevent debris and other sediment from entering the manhole structure while allowing water to drain into the manhole inlet structure. The overflow outlet controls the maximum height that the water level may reach before allowing rapid drainage into the manhole inlet structure.

In yet other embodiments, the annular ring and cap are rectangular in shape. The annular ring is positioned within the base or cone of a catch basin. The rectangular cap is then snapped into place, engaging the ledge of the annular ring. The upper surface of the cap may be partially domed or conical as described above and may include perforations to thereby form a secondary grate for the catch basin.

OBJECTS

It is accordingly a principal object of the present invention to provide a device a lightweight, corrosion resistant, durable device for restricting the flow of debris into the manhole or catch basin structure.

Another object of the present invention is to a device for restricting the flow of debris into the manhole or catch basin structure that is adaptable to be disposed above a base of the manhole or catch basin and may be used both during the construction of roadways and after the final grade has been completed.

A further object of the present invention is to provide a device for restricting the flow of debris into a manhole or catch basin structure that includes a means of deterring access into the underground conduits that link manholes or catch basins together.

Still another object of the present invention is to provide an overflow drainage that deters access into the base of the manhole or catch basin.

Yet another object of the present invention is to provide a device that is positionable below the manhole or catch basin cover or grating that includes indicia that identifies the type of access opening.

These and other objects and advantages of the present invention will become readily apparent to those skilled in the art from a review of the following detailed description of the preferred embodiment especially when considered in conjunction with the claims and accompanying drawings in which like numerals in the several views refer to corresponding parts.

DETAILED DESCRIPTION

Figure 1:
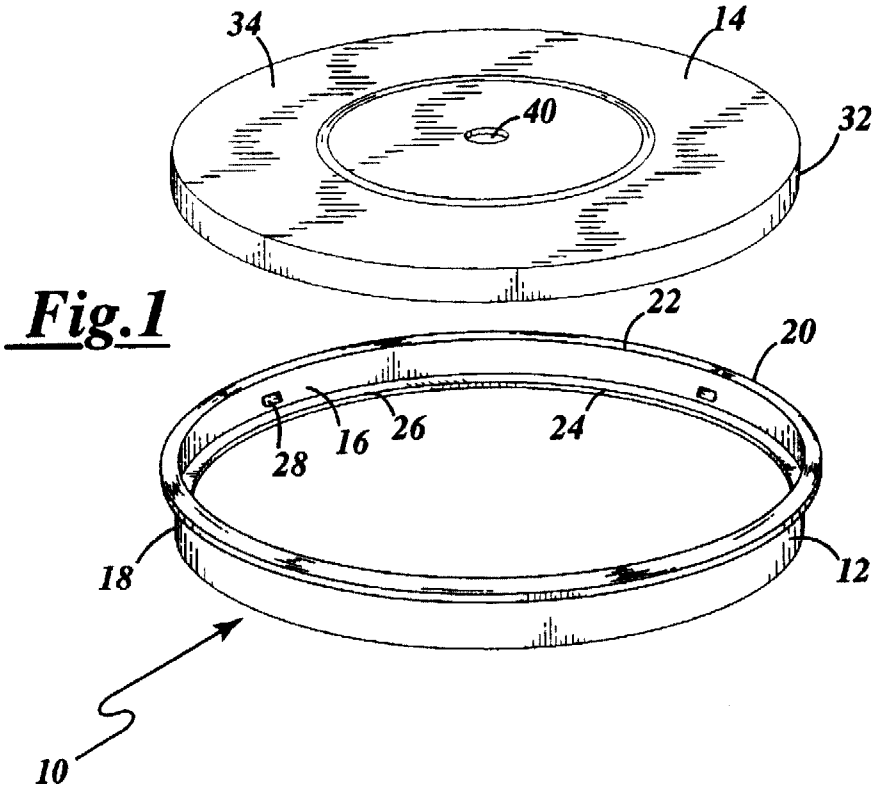
FIG. 1 is a perspective view of a cylindrical annular ring and a cylindrical partially domed cap of the present invention, wherein the cap is elevated above the ring.

Referring first to FIG. 1, there is shown generally the debris catcher 10. The debris catcher 10 generally includes an annular ring 12 and cap 14. The annular ring 12 comprises inner and outer sidewalls 16 and 18 respectively, a flange 20 extending perpendicularly outward from an upper edge 22 of the annular ring 12 and a ledge 24 extending perpendicularly inward from a lower edge 26 of the annular ring 12. Locking members 28 extend inward from the inner sidewall 16 of the annular ring 12 towards the center of the annular ring 12. A lower engaging edge of each locking member 28 is aligned and positioned above the ledge 24 at a height slightly greater than the height of the cap sidewalls (see FIG. 3), whereby the cap 14 is pressed down past each locking member 28 snapping into place against the ledge 24.

The cap 14 includes inner and outer sidewalls 30 and 32 respectively (see also FIGS. 3 and 5), wherein the outer sidewall 32 is shaped to conform to the inner sidewall 16 of the annular ring 12. A partially domed top surface 34 extends from the outer sidewall 32. A flat planar surface 36 is formed proximate the apex of the top surface 34 of the cap 14. As shown in FIG. 4, indicia 38 may be included on the flat planar surface 36. As indicated above, the indicia 38 may be alpha, numeric, or a combination thereof to identify the type of manhole or catch basin in which the debris catcher 10 is positioned. A bore 40 may extend through a thickness dimension (between the inner and outer sidewalls 30 and 32) of the cap 14, proximate the center of the cap 14. When the debris catcher 10 is positioned within the manhole or catch basin, the bore acts as an overflow outlet for water draining into the manhole system. Although the bore 40 is shown as a generally circular aperture, it is to be understood that the bore may be formed in any number of different shapes without departing from the scope of the present invention. The bore 40 may be plugged to thereby prevent water from draining past the debris catcher 10 and into the manhole base.

Figure 2:
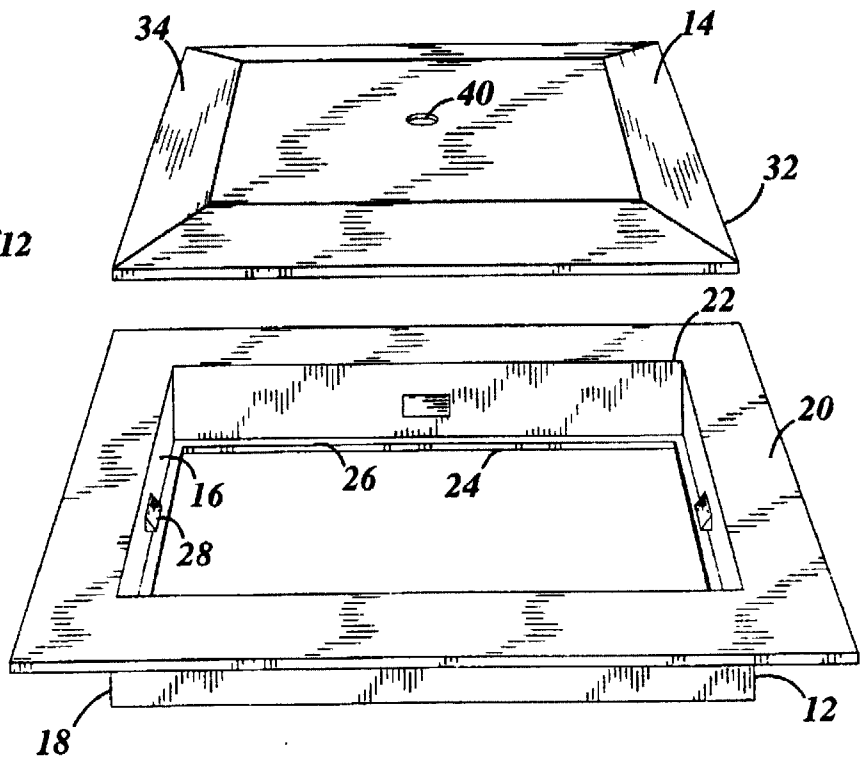
FIG. 2 is a perspective view of a rectangular annular ring and a rectangular partially domed cap of the present invention, wherein the cap is elevated above the ring.

FIG. 2 shows an alternate embodiment of the annular ring 12 and cap 14. The annular ring 12 and cap 14 are rectangular in shape, wherein in the outer sidewall 18 of the annular ring is sized to fit within the opening of a base or cone of a catch basin. The inner sidewall 16 of the annular ring 12 and both the inner and outer sidewalls 30 and 32 of the cap 12 are also rectangular in shape (see also FIG. 7). When the cap 14 is positioned on the ledge 24, debris and sediment carded by water drain into the catch basin and fall along the slope of the partially domed cap 12. The debris falls towards the lower outer sidewall 32 of the cap 14, while the water drains into the catch basin system through the bore 40.

Figure 3:
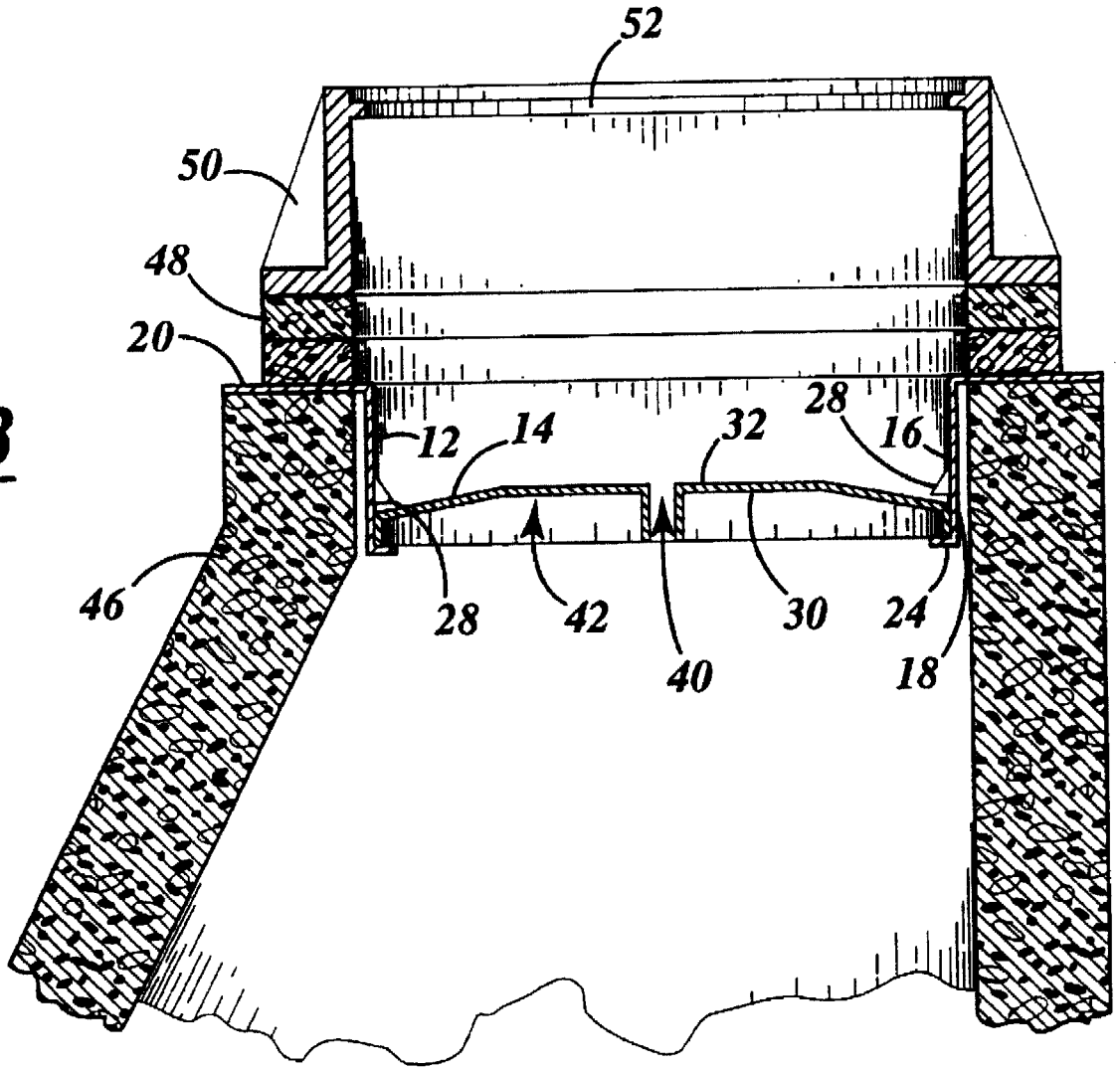
FIG. 3 is an enlarged sectional view of the annular ring and cap of the type shown in FIG. 1, positioned within a manhole structure.
Figure 4:
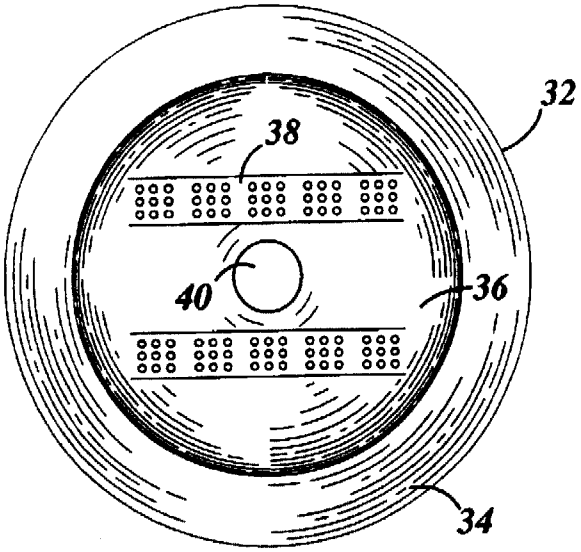
FIG. 4 is a top plan view of the cap of the type shown in FIG. 1.
Figure 5:
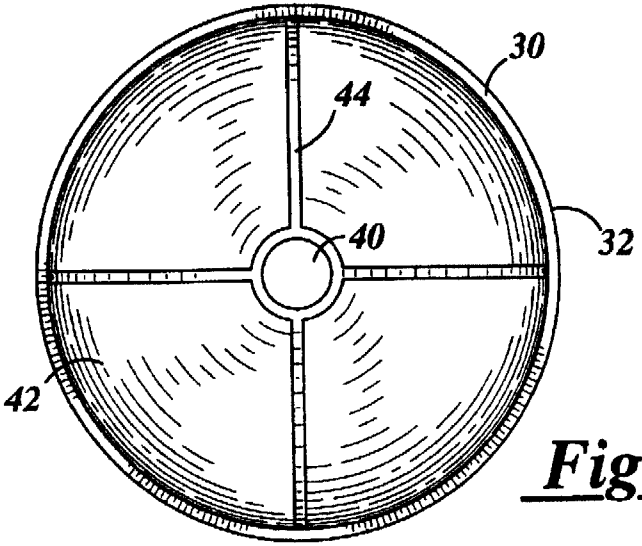
FIG. 5 is a bottom plan view of the cap of the type shown in FIG. 1.
Figure 7:
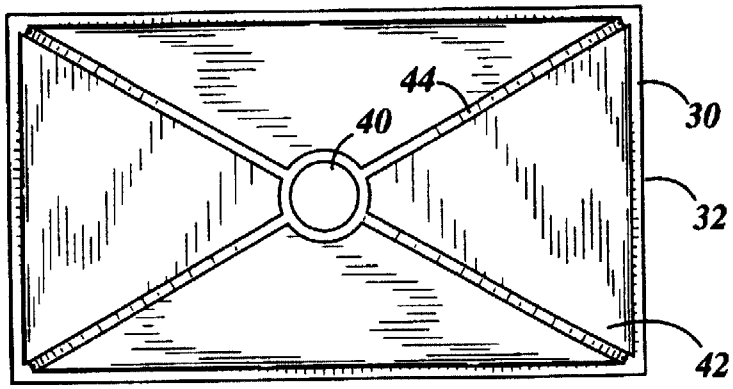
FIG. 7 is a bottom plan view of the cap of the type shown in FIG. 2.

As seen in FIGS. 3, 5 and 7, a bottom surface 42 of the cap 14 is partially concave and extends upward from the inner sidewall 30 of the cap 14. Support ribs protrude from the bottom surface 42 and extend between the inner sidewall 30 and the bore's 40 sidewall. The ribs reinforce the cap, thereby allowing a weight bearing load to be applied on the cap 14, without the center of the cap 14 collapsing from the load.

Referring again to FIG. 3, the annular ring 12 and cap 14 are shown positioned within a manhole structure. The flange 20 of the annular ring 12 is positioned between the top annular surface of the manhole base or cone 46 and extension rings 48. The support frame 50 rests on top of the extension rings 48. The support frame 50 includes a lip 52 on which a manhole cover or grating may rest. The distance between the flat planar surface 36 of the cap 14 and the lip 52 of the support frame 50 should be greater than one half the diameter of the manhole cover or grating so that during removal of the cover, the cover may rotate down into the opening of the support frame without contacting the cap 14. The height of the annular ring 12 may vary, to thereby increase or decrease the distance between the flat planar surface 36 of the cap 14 and the lip 52 of the support frame 50.

Figure 6:
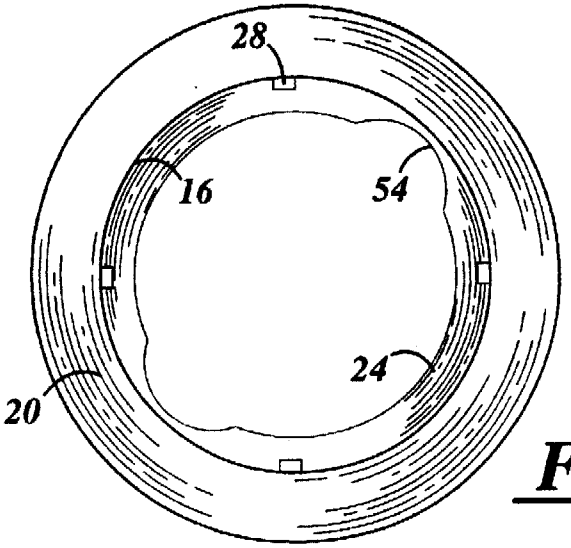
FIG. 6 is a top plan view of the annular ring of the type shown in FIG. 1.

FIG. 6 is a top view of the annular ring 12 removed from the manhole structure. The ledge 24 has two cut away portions or shoulder indentations 54 aligned diametrically opposite each other, thereby creating shoulder clearance. Although the ledge 24 further restricts the size of the access opening into the manhole structure, the shoulder clearance indentations 54 increases the diameter of the ledge 24 proximate the shoulder clearance to be approximately equal to the inner diameter of the inner sidewall 16 of the annular ring 12.

Figure 8:
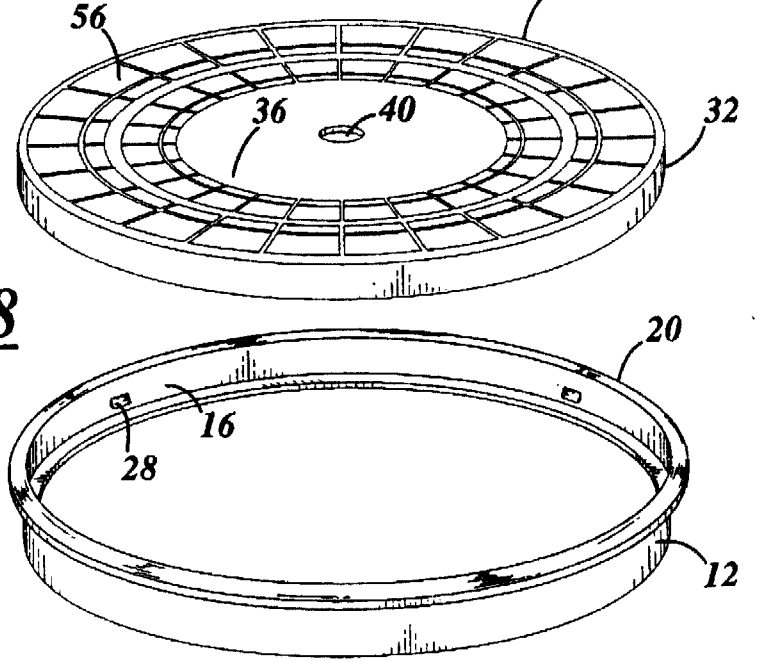
FIG. 8 is a perspective view of an alternate embodiment of the cylindrical annular ring and partially domed cap, wherein the cap is elevated above the ring.

FIGS. 8–12 show several alternate embodiments of the present invention. It is to be understood that the size and shape of the cap 14 may be modified without exceeding the scope of the present invention. FIG. 8 shows an annular ring 12 and cap 14, similar to that described above, wherein the cap 14 includes a plurality of perforations 56 formed within the cap 14 extending between the domed surface 34 and bottom surface 42. Those skilled in the art will appreciate that the size, shape, and number of the perforations 56 may vary depending upon the desired size of debris to be filtered by the cap 14.

Figure 10:
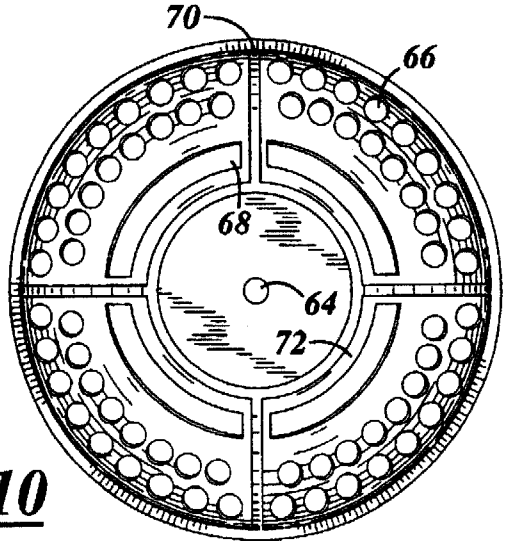
FIG. 10 is a bottom plan view of the cap of the type shown in FIG. 9.
Figure 9:
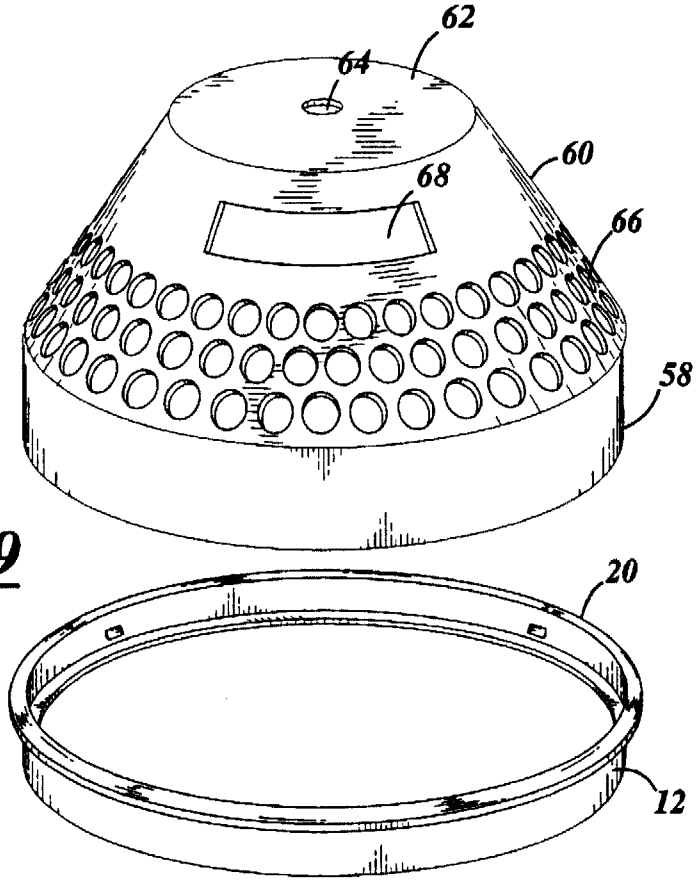
FIG. 9 is a perspective view of an alternate embodiment of the cylindrical annular ring and partially conical cap, wherein the cap is elevated above the ring.
Figure 12:
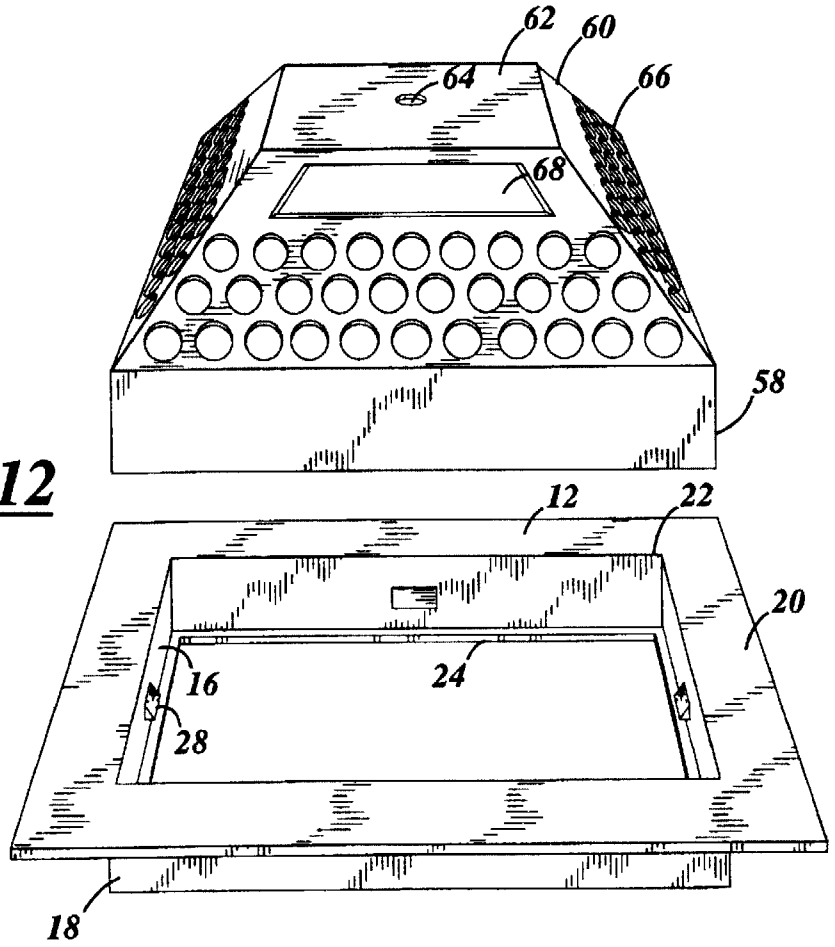
FIG. 12 is a perspective view of an alternate embodiment of the rectangular annular ring and partially conical rectangular cap, wherein the cap is elevated above the ring.

FIGS. 9 and 10 shows another embodiment of the cap 14 having an outer sidewall 58, a conical upper surface 60 and a flat top 62. A bore extends through the flat top 62 of the cap 14. A plurality of perforations or apertures extend through the conical upper surface 60 of the cap 14. An enlarged perforation 68 also extends through the conical upper surface 60 of the cap 14. The enlarged perforation 68 serves as an overflow outlet. Those skilled in the art will appreciate that the top surface of the cap 14 may be formed into an enlarged opening to create a large overflow opening. Support ribs 70 are formed on the lower surface 72 of the cap 14 to provide support to the cap when the cap 14 is submerged in water. FIG. 12 is an embodiment similar to that shown in FIG. 9, wherein the shape of the annular ring 12 and cap 14 are rectangular in shape, so as to conform to the opening of a base or cone of a rectangular catch basin.

Figure 11:
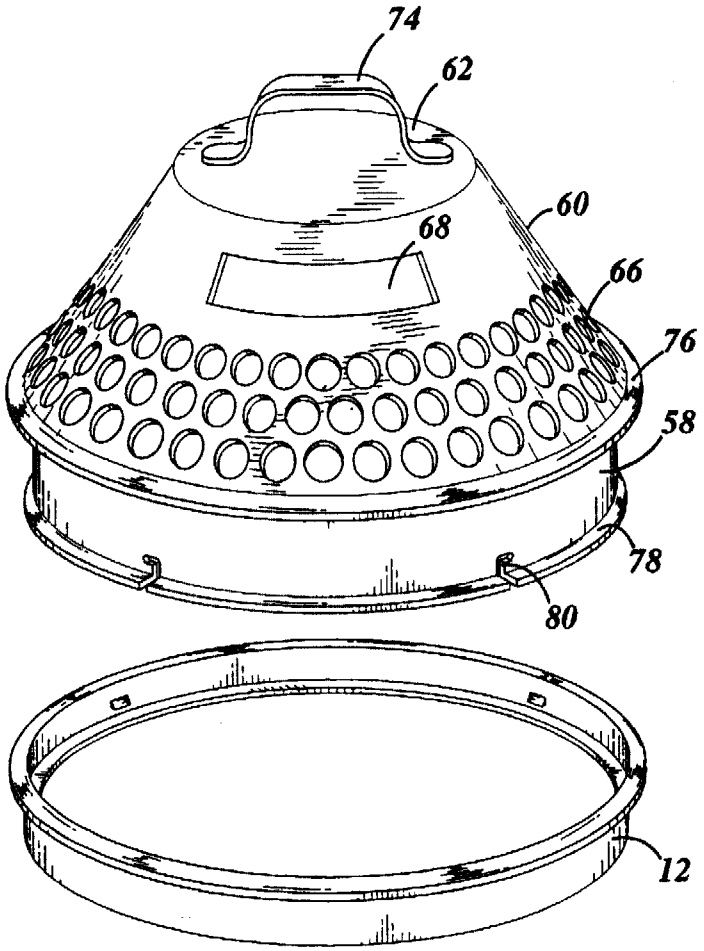
FIG. 11 is a perspective view of an alternate embodiment of the cylindrical annular ring and partially conical cap, wherein the cap is elevated above the ring.

FIG. 11 shows cap 14 of the type shown in FIG. 9, further including a handle 74 extending from the flat top surface 62 of the cap 14. An upper annular lip 76 extends perpendicularly outward from an upper edge of the outer sidewall 58. When the cap 14 is aligned and engaged with the annular ring 12, the lip 76 rest on top of the flange 20. A lower annular lip 78 extending perpendicularly outward from a lower edge of the outer sidewall 58 snaps under the locking members 28 and engages the ledge 24 of the annular ring 12. As the cap 14 is aligned and engaged with the annular ring 12, the locking member slides along groove 80 formed in the sidewall 58 of the cap 14. Once the lower annular lip 78 is engaged with the ledge 24, the cap 14 is rotated. As the cap rotates the locking members follow the curve of the groove 80. Following rotation, the cap 14 is held in place against the ledge 24 and can not be pulled away from the ledge, without first rotating the cap 14. Alternatively, the lip 76 may be aligned and engaged to the base or cone, wherein the upper annular lip 76 rests directly on the top annular surface of the base or cone.

Having described the constructional features of the present invention the mode of use will now be presented in further detail. The debris catcher 10 may be used by an operator both during the construction of manhole and catch basin structures and after completing the final grade surrounding the manhole or catch basin structure. Once the manhole base and/or cone have been constructed, the operator positions the outward protruding flange 20 of the annular ring 12 on top of the uppermost annular surface of the base or cone. The intended use of the debris catcher is then determined in order to select an embodiment of the cap 14 most suited for the intended use. Without any limitation intended, the cap 14 may be used as a secondary manhole cover, a secondary catch basin grate, or a secondary manhole inlet grate. The selected cap 14 is then snapped into place against the ledge 24 of the annular ring 12. Extension rings 48 and the support frame 50 may be stacked on top of the flange 20, and the grade may be brought up level with the top of the support frame 50.

A filtering fabric or other filtering medium of known construction may be positioned around the upper surface 34 or 60 of the cap 14 to further prevent debris and other sediment from entering the base of the manhole. During heavy rains or other drainage events, the water level may raise above the support frame 50 and may even submerge the cap 14. The filtering fabric would prevent debris and other sediment from entering the manhole structure while allowing water to quickly drain into the manhole inlet structure through the enlarged overflow bore 40 or perforation 66. The overflow outlet 68 controls the maximum height that the water level may reach before allowing rapid drainage into the manhole inlet structure.

This invention has been described herein in considerable detail in order to comply with the patent statutes and to provide those skilled in the art with the information needed to apply the novel principles and to construct and use such specialized components as are required. However, it is to be understood that the invention can be carried out by specifically different devices, and that various modifications, both as to the equipment details and operating procedures, can be accomplished without departing from the scope of the invention itself.

What is claimed is:

1. An apparatus adapted to be disposed above a base of a manhole or catch basin, wherein the apparatus deters access to underground conduits that are linked to the manhole or catch basin, said apparatus comprising:

(a) an annular ring having inner and outer concentric sides, a central opening sized for user access therethrough, and shaped to fit within an opening of the base, said annular ring having a flange extending outwardly from an upper edge of the annular ring and further having a ledge extending inwardly from a lower edge of the annular ring towards a center axis of said annular ring, wherein said flange is adapted for disposal between the base and a support frame;

(b) a cap having an outer perimeter conforming to the shape of said annular ring and further having a partially conical top surface and a partially concave bottom surface; and (c) a plurality of corrosion resistant locking members integral with an inner side of said annular ring, said locking members being adapted to secure the cap against the ledge of said annular ring.

2. The apparatus as recited in claim 1, wherein said cap has a plurality of perforations formed through a thickness dimension of the cap.

3. The apparatus as recited in claim 1, wherein said ring and cap are rectangular in shape.

4. The apparatus as recited in claim 1, wherein at least a portion of the partially conical top surface of said cap extends upward above a plane formed by said flange when said cap is engaged with said annular ring.

5. The apparatus as recited in claim 4, wherein said cap has a plurality of perforations formed through a thickness dimension of the cap.

6. The apparatus as recited in claim 5, wherein said cap further has an enlarged perforation formed through a thickness dimension of the cap, thereby forming an overflow outlet.

7. An apparatus adapted to be disposed above a base of a manhole or catch basin, wherein the apparatus deters access to underground conduits that are linked to the manhole or catch basin, said apparatus comprising:

(a) an annular ring having inner and outer concentric sides, a central opening sized for user access therethrough, and shaped to fit within an opening of the base, said annular ring having a flange extending outwardly from an upper edge of the annular ring and further having a ledge extending inwardly from a lower edge of the annular ring towards a center axis of said annular ring, wherein said flange is adapted for disposal between the base and a support frame;

(b) a cap having an outer perimeter conforming to the shape of said annular ring and further having a partially domed top surface and a concave bottom surface, wherein support ribs extend outwards to said outer perimeter from said bottom surface; and (c) corrosion resistant locking members protruding inwards from the inner side of said annular ring, said locking members being adapted to secure the cap against the ledge of said annular ring.

8. The apparatus as recited in claim 7, wherein said cap has a bore extending through a thickness dimension of the cap, proximate the center axis of the cap.

9. The apparatus as recited in claim 7, wherein said cap has a plurality of perforations formed through a thickness dimension of the cap.

10. The apparatus as recited in claim 7, wherein an inner edge of said ledge has first and second shoulder clearance indentations aligned opposite each other to thereby increase an inside diameter of said ledge proximate said shoulder clearance indentations.

11. The apparatus as recited in claim 7, wherein the domed top surface of said cap includes indicia formed on said top surface to identify a surrounding structure.

12. The apparatus as recited in claim 7, wherein said ring and cap are rectangular in shape.

13. The apparatus as recited in claim 7, wherein at least a portion of the domed top surface of said cap extends upward above a plane formed by said flange when said cap is engaged with said annular ring.

14. The apparatus as recited in claim 13, wherein said cap has a plurality of perforations formed through a thickness dimension of the cap.

15. The apparatus as recited in claim 14, wherein said cap further has an enlarged perforation formed through a thickness dimension of the cap, thereby forming an overflow outlet.

16. An apparatus adapted to be disposed above a base of a manhole or catch basin, wherein the apparatus deters access to underground conduits that are linked to the manhole or catch basin, said apparatus comprising:

(a) an annular ring having inner and outer concentric sides and shaped to fit within an opening of the base, said annular ring having a flange extending outwardly from an upper edge of the annular ring and further having a ledge extending inwardly from a lower edge of the annular ring towards a center axis of said annular ring, wherein said flange is adapted for disposal between the base and a support frame and an inner edge of said ledge has first and second user clearance indentations aligned opposite each other to thereby increase an inside diameter of said ledge proximate said user clearance indentations;

(b) a cap having an outer perimeter conforming to the shape of said annular ring and further having a top surface and a bottom surface; and (c) a plurality of corrosion resistant locking members each protruding towards the center axis of said annular ring from an inner side of said annular ring, said locking members being adapted to secure the cap against the ledge of said annular ring.

17. The apparatus as recited in claim 16, wherein said cap has a bore extending through a thickness dimension of the cap, proximate the center axis of the cap.

18. The apparatus as recited in claim 16, wherein said cap has a plurality of perforations formed through a thickness dimension of the cap.

19. The apparatus as recited in claim 16, wherein the top surface of said cap includes indicia formed on said top surface to identify a surrounding structure.

20. The apparatus as recited in claim 16, wherein said ring and cap are rectangular in shape.

21. The apparatus as recited in claim 16, wherein, when said cap is engaged with said annular ring, at least a portion of the top surface of said cap extends upward above a plane defined by said flange.

22. The apparatus as recited in claim 21, wherein said cap has a plurality of perforations formed through a thickness dimension of the cap.

23. The apparatus as recited in claim 22, wherein said cap further has an enlarged perforation formed through a thickness dimension of the cap, thereby forming an overflow outlet.

* * * * *